US007815471B2

(12) United States Patent
Wu

(10) Patent No.: US 7,815,471 B2
(45) Date of Patent: Oct. 19, 2010

(54) ROTATABLE ELECTRICAL INTERCONNECTION DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 81 days.

(21) Appl. No.: 12/221,292

(22) Filed: Aug. 1, 2008

(65) Prior Publication Data

US 2010/0029095 A1 Feb. 4, 2010

(51) Int. Cl.
*H01R 25/00* (2006.01)

(52) U.S. Cl. ..... 439/640; 439/31

(58) Field of Classification Search ..... 439/640, 439/638, 171, 173, 11–14, 31
See application file for complete search history.

(56) References Cited

U.S. PATENT DOCUMENTS

| | | | | |
|---|---|---|---|---|
| 3,190,978 | A * | 6/1965 | Huget | 200/51 R |
| 4,850,882 | A * | 7/1989 | Yu | 439/31 |
| 5,183,404 | A * | 2/1993 | Aldous et al. | 439/55 |
| 5,542,850 | A * | 8/1996 | Frantz | 439/31 |
| 5,658,152 | A | 8/1997 | Selker | |
| 5,681,171 | A * | 10/1997 | Park | 439/31 |
| 5,833,482 | A * | 11/1998 | Buchter | 439/288 |
| 6,074,253 | A * | 6/2000 | Brinchmann-Hansen | 439/624 |
| 6,193,522 | B1 * | 2/2001 | Liao | 439/31 |
| 6,213,782 | B1 * | 4/2001 | Derstine | 439/31 |
| 6,280,258 | B1 * | 8/2001 | Frohlund | 439/700 |
| 6,343,957 | B1 | 2/2002 | Kuo et al. | |
| 6,695,620 | B1 * | 2/2004 | Huang | 439/11 |
| 6,786,734 | B2 * | 9/2004 | Yu | 439/11 |
| 6,991,467 | B1 * | 1/2006 | Cheng et al. | 439/10 |
| 7,033,199 | B2 * | 4/2006 | Funatsu | 439/341 |
| 7,066,753 | B1 * | 6/2006 | Tseng | 439/259 |
| 7,128,615 | B1 * | 10/2006 | Liao | 439/640 |
| 7,160,125 | B1 * | 1/2007 | Teicher | 439/173 |
| 7,172,428 | B2 * | 2/2007 | Huang | 439/11 |
| 7,234,961 | B2 * | 6/2007 | Arlitt et al. | 439/410 |
| 7,422,488 | B1 * | 9/2008 | Wu | 439/676 |
| 7,628,467 | B2 * | 12/2009 | Silverbrook | 347/32 |

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

An electrical interconnection device (100) includes a first connector (1) having an insulated housing (14) and at least a pogo type contact (15) mounted to the insulated housing; a second connector (2) having base portion (20) and a terminal (25) assembled to the base portion, said terminal having an arc-shaped mating segment; and the first connector pivotally linked to the second connector, with the insulated housing of the first connector disposed adjacent to the base portion of the second connector, the contact (15) pressing onto and sliding along the mating segment of the terminal (25) while the first connector and the second connector are swiveled with respect to one another.

17 Claims, 9 Drawing Sheets

ROTATABLE ELECTRICAL INTERCONNECTION DEVICE

BACKGROUND OF THE INVENTION

1. Field of the Invention

The present invention generally relates to an electrical interconnection device, and more particularly to an electrical interconnection device which has two connector members interconnected together and capable of swiveling with respect to one another.

2. Description of Related Art

An electrical interconnection device is used for connecting two electronic devices. There are many different kinds of electrical interconnection devices, such as cable connector assembly and an electrical adapter. The cable connector assembly is mainly used for connecting two electronic devices relatively far away from each other; while the electrical adapter is utilized for connecting two electronic devices neighbored each other and usually have different I/O interfaces.

U.S. Pat. No. 6,343,957 issued to Kuo on Feb. 5, 2002 discloses a DVI electrical adapter for electrically connecting a monitor to a host computer having different interfaces. The electrical adapter includes a combined digital & analog receptacle connector, a digital-only plug connector, two printed circuit boards joined between the plug connector and the receptacle connector, an insulative housing insert molded over a center of the electrical adapter and a pair of elongated fasteners. The elongated fasteners project through two sides of the insulative housing and include a first fixing end and a second fixing end. The second fixing end engages with nuts of a complementary receptacle connector mounted on the host computer. The first fixing end has a threaded recess accepting screws from a cable plug connector attached to the monitor. However, the receptacle connector and the plug connector of the aforementioned electrical adapter are not able to swivel with respect to one another, which may restrict usage of the electrical adapter in certain field.

U.S. Pat. No. 5,658,152 issued to Selker on Aug. 19, 1997 introduces a swivel plug. The plug is has male and female plug portions which pivot 180 degree, with respect to one another about a common pivot axis between first and second positions. A plurality of male and female electrical contact pairs slidably engage one another and pivot about the common pivot axis. Male and female bodies, which receive the electrical contact pairs, also pivot with respect to one another about the common pivot axis. The male and female bodies and the male and female electrical contact pairs are arranged in a novel relationship to mutually retain one other for the pivotal movement. The swivel plug eliminates the need for an electrical cord between an adapter of a laptop computer and a wall receptacle which has a downwardly located ground receptacle or a wall receptacle which has an upwardly located ground receptacle. The swivel plug also enables plugging a computer adapter or a typical extension cord into a receptacle where there is a rigid space constraint. However, an joint portion between the male and female electrical contact pairs may loosen and fail to achieve good electrical connection therebetween.

Hence, an improved electrical interconnection device is highly desired to overcome the aforementioned problems.

SUMMARY OF THE INVENTION

Accordingly, an object of the present invention is to provide an improved swiveled electrical interconnection device.

In order to achieve the object set forth, an electrical interconnection device in accordance with the present invention comprises a first connector having an insulated housing and at least a pogo type contact mounted to the insulated housing; a second connector having base portion and a terminal assembled to the base portion, said terminal having an arc-shaped mating segment; and the first connector pivotally linked to the second connector, with the insulated housing of the first connector disposed adjacent to the base portion of the second connector, the contact pressing onto and sliding along the mating segment of the terminal while the first connector and the second connector are swiveled with respect to one another.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
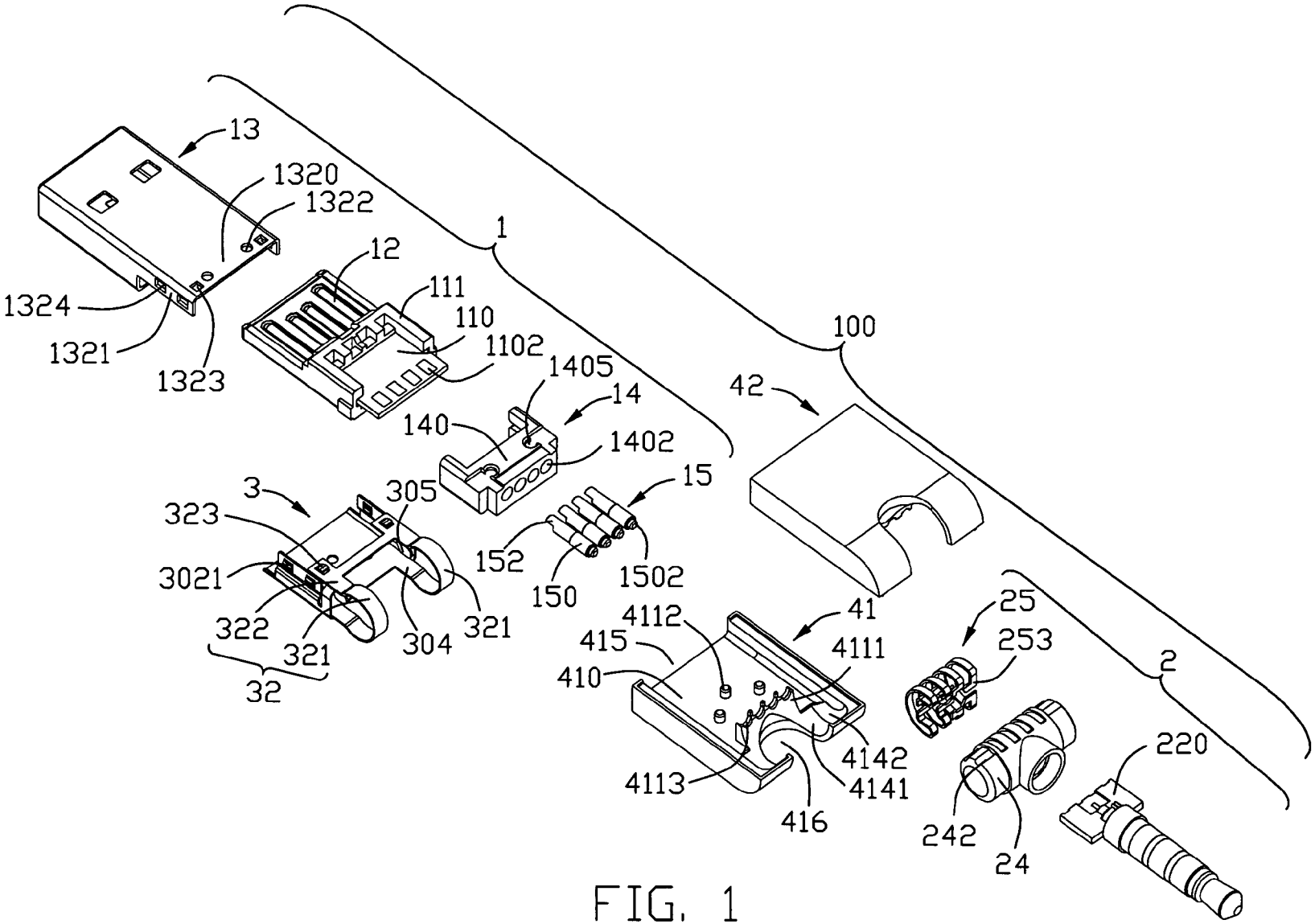
FIG. 1 is an exploded, perspective view of an electrical interconnection device in accordance with the present invention.
Figure 2:
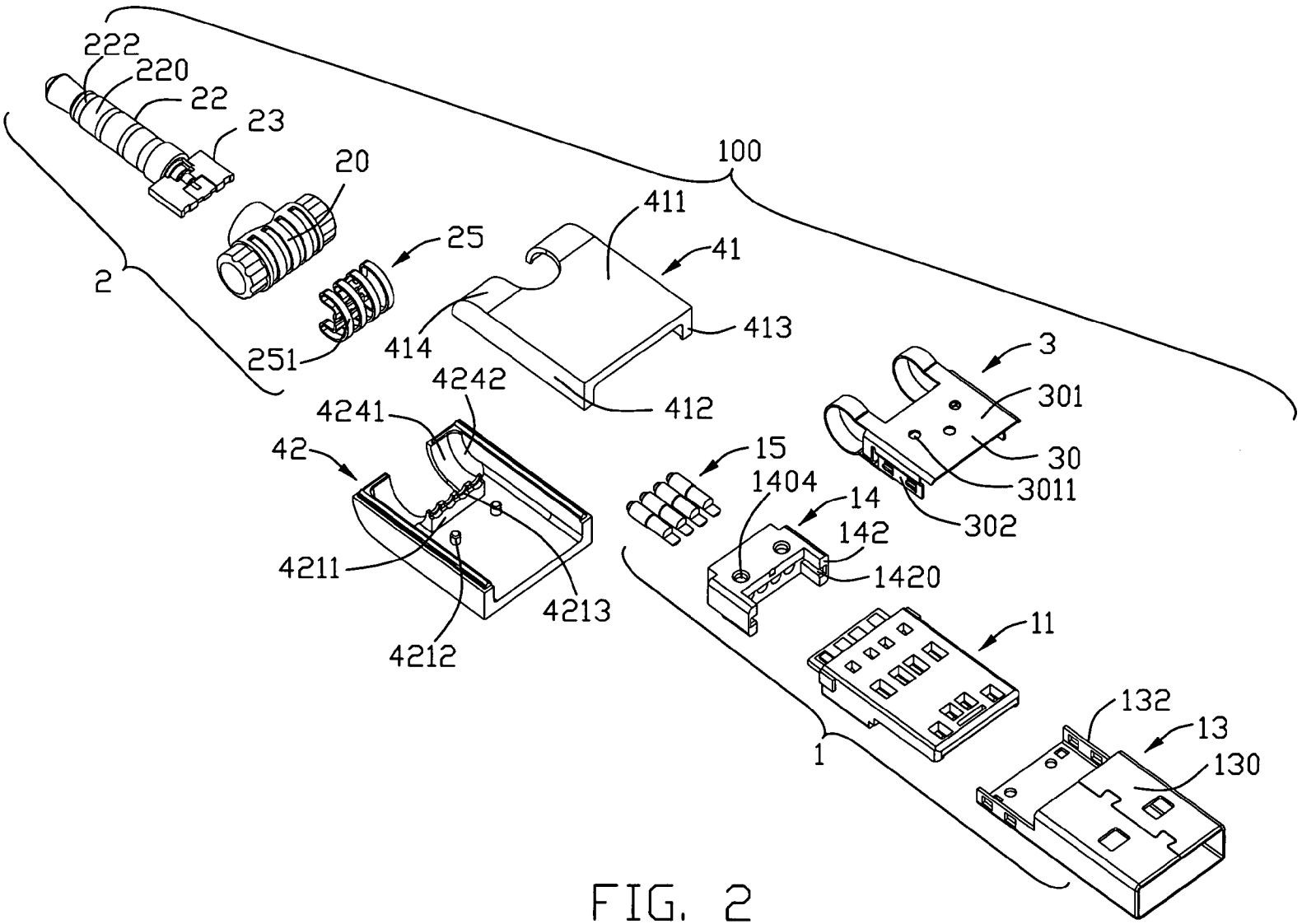
FIG. 2 is similar to FIG. 1, but viewed from another aspect.
Figure 3:
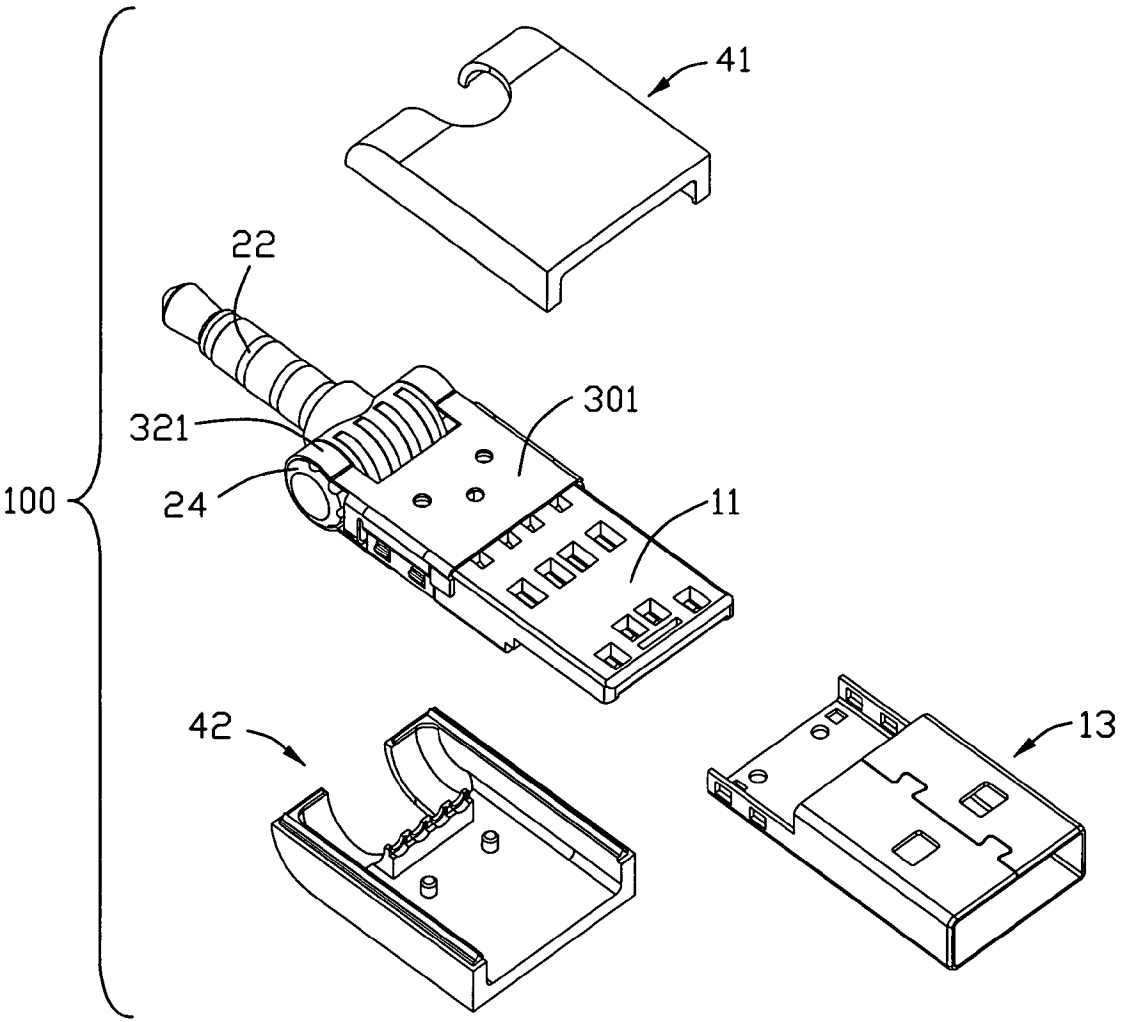
FIG. 3 is a partially assembled, perspective view of the electrical interconnection device.
Figure 4:
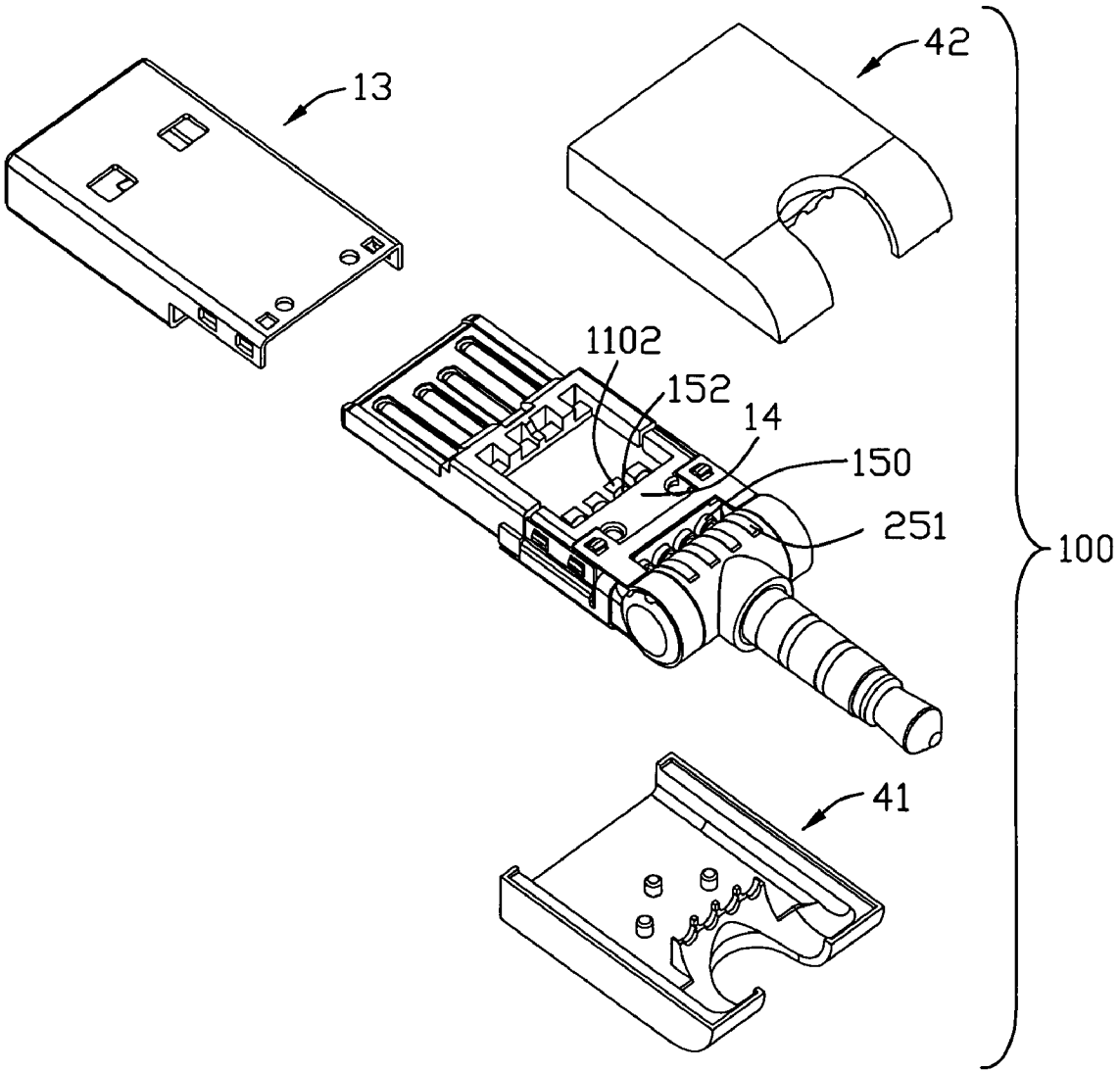
FIG. 4 is similar to FIG. 3, but viewed from another aspect.
Figure 5:
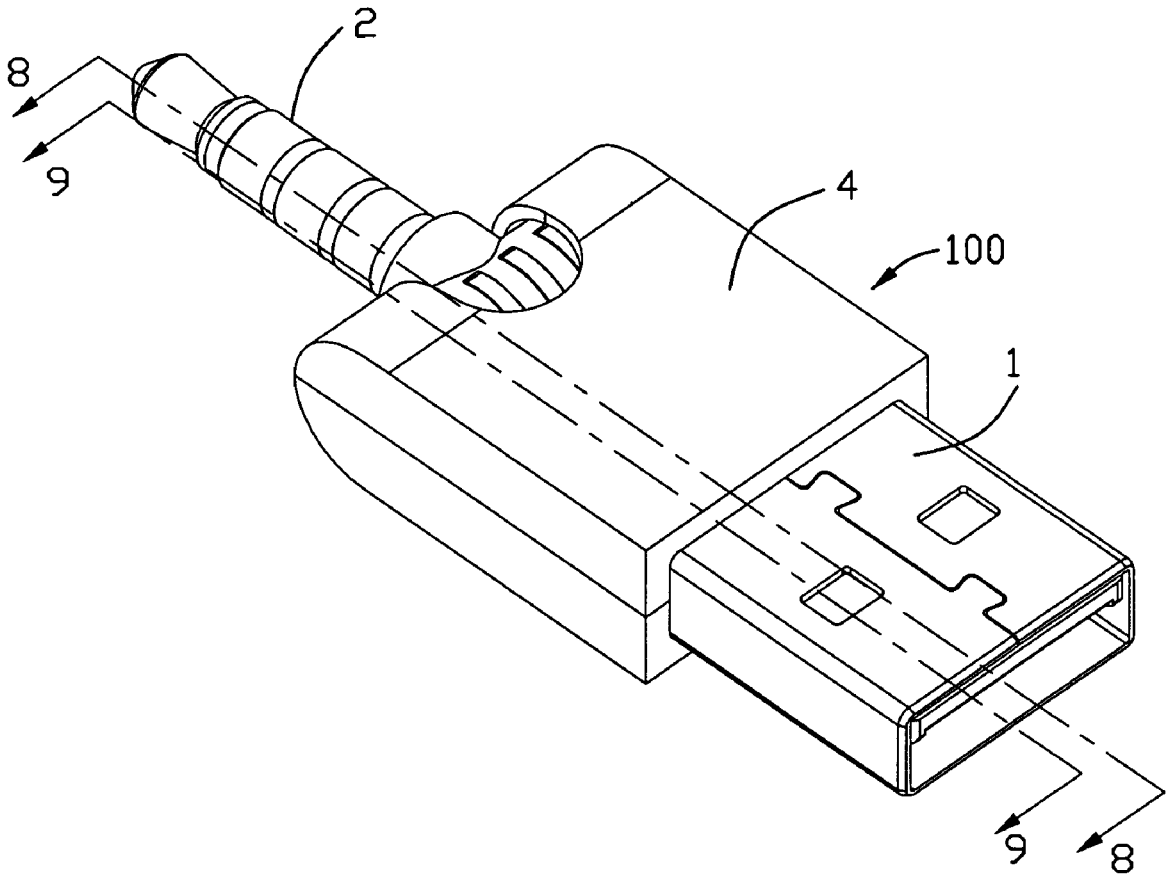
FIG. 5 is an assembled, perspective view of the electrical interconnection device.
Figure 6:
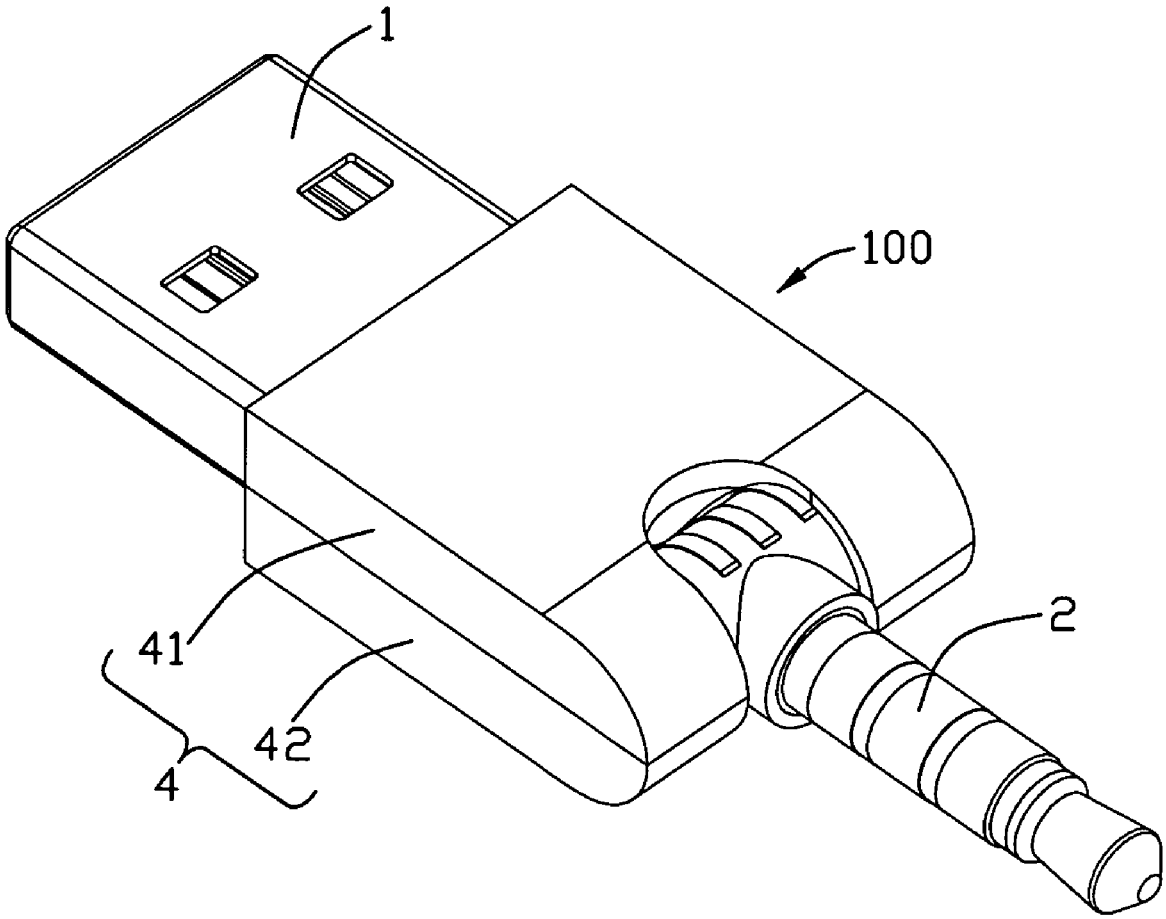
FIG. 6 is similar to FIG. 5, but viewed from another aspect.
Figure 7:
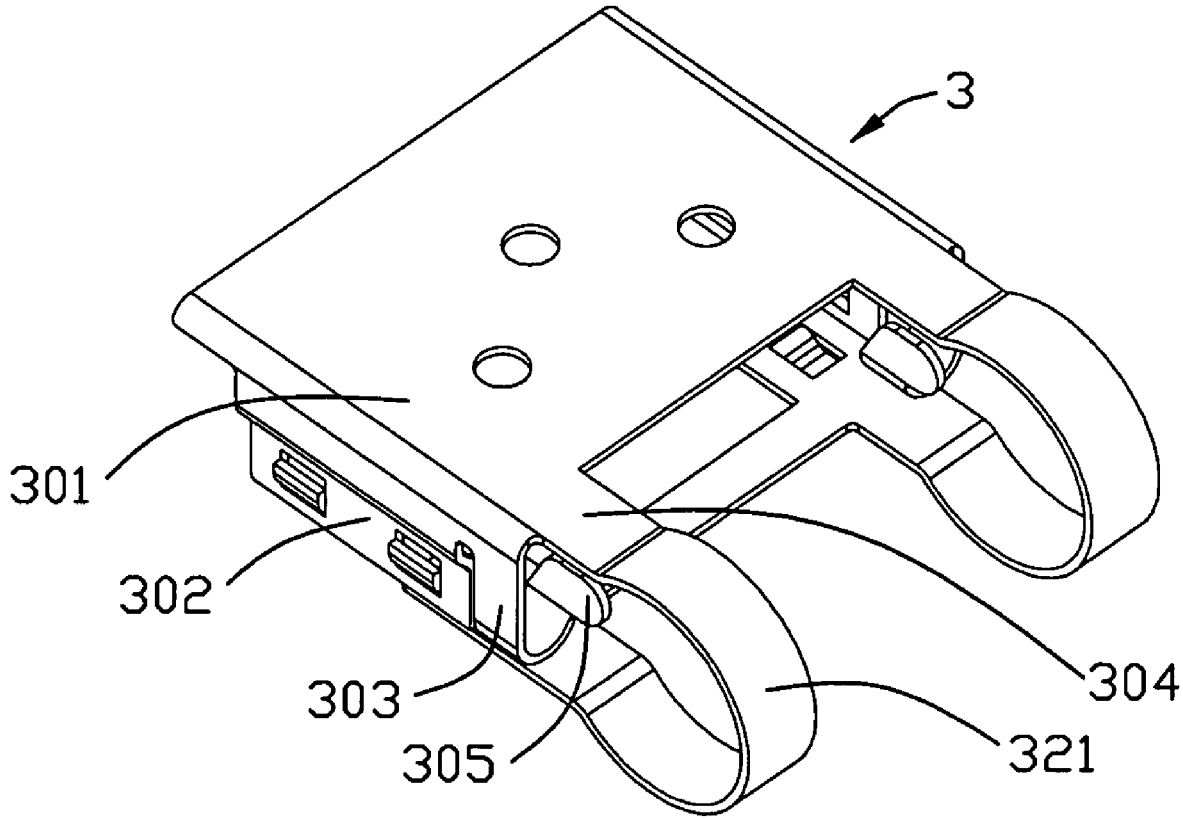
FIG. 7 is a hinge member of the electrical interconnection device.
Figure 8:
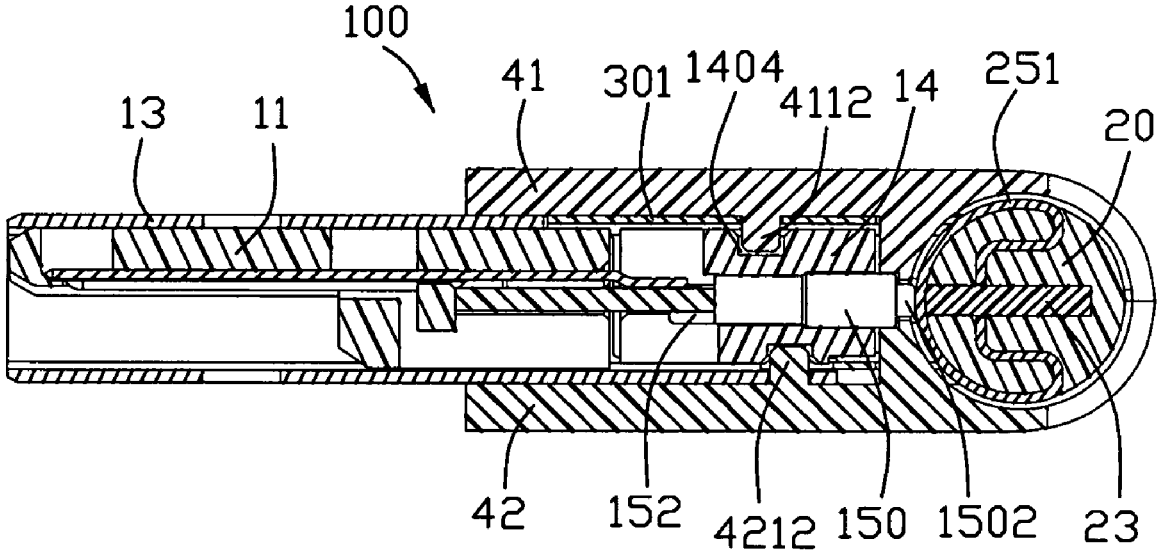
FIG. 8 is a cross-section view of FIG. 5 taken along line 8-8.
Figure 9:
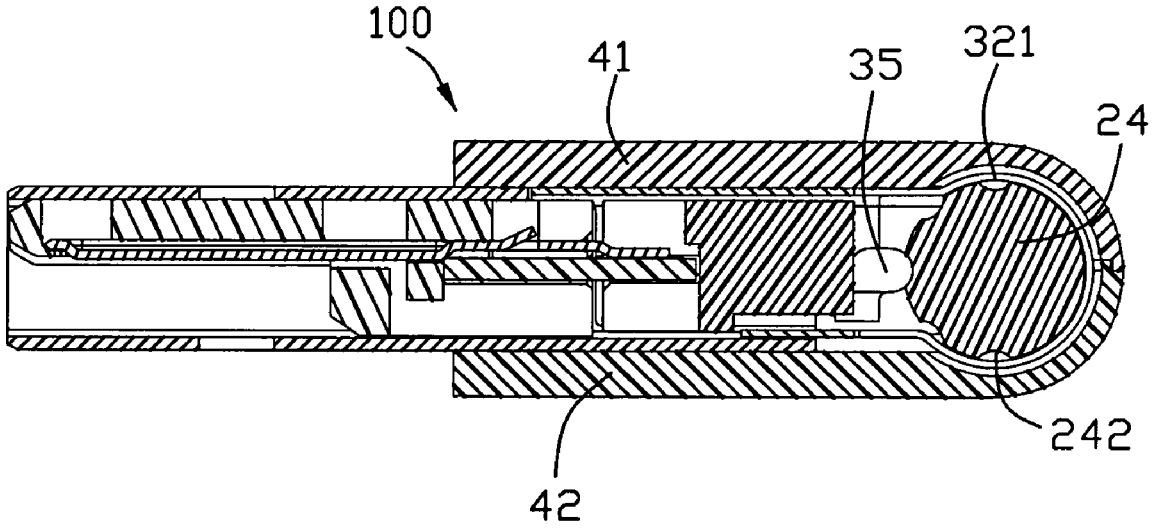
FIG. 9 is a cross-section view of FIG. 5 taken along line 9-9.

Referring to FIGS. 1-9, an electrical interconnection device 100 in accordance with the present invention comprises a first connector 1, a second connector 2 and a hinge member 3 linking the first connector 1 and the second connector 2, a cover 4 partially enclosing the first and second connectors 1, 2.

The first connector 1 is compatible with Universal Serial Bus (USB) transmitting protocol, however, it can be other types connector. The first connector 1 includes a first insulated housing 11, a number of first contacts 12 mounted to the first insulated housing 11 and a metallic shell 13 enclosing the first insulated housing 11. A pair of flange portions 111 are respectively formed at lateral sides of a rear section of the first insulated housing 11. A board member 110 is secured between the pair of flange portions 111 and rearward extends beyond back surface of the first insulated housing 11. A number of conductive pads 1102 are arranged on a surface of the back segment of the board member 110. The conductive pads 1102 are electrically connected to rear portions of the first contacts 12. However, in alternative embodiment, the conductive pads 1102 may be parts of the rear portions of the first contacts 12.

The first connector 1 further includes a second insulated housing 14. The second insulated housing 14 has a rectangular-shaped main body 140 and a pair of arm portions 142 extending forwardly from lateral sides of a front surface thereof. The pair of arm portions 142 further have two grooves 1420 defined in inner sides thereof. The board member 110 is held between the pair of arm portions 142, with lateral edges of a back portion thereof received in the two grooves 1420 of the arm portions 142. Thus, the first insulated housing 11 and the second insulated housing 14 are combined together to form an insulated housing unit. However, it should note that the housing unit may be one-piece element member, without separated two individual segments. Two apertures 1404 are defined in an up section the main body 140 and another pair of apertures 1405 are defined in a low section of the main body 140. A number of contact passages 1402 pass through a front and back surface of the main body 140.

A number of pogo-type second contacts 15 are assembled to the second insulated housing 14. Each of the second contacts 15 includes a body portion 150 accommodated in the contact passage 1402, a tail portion 152 extending beyond the back surface of the main body 140, a mating portion 1502 disposed out of the front surface of the main body 140. The mating portion 1502 is assembled to the body portion 150 and capable of movement along an axial direction of the body portion 150. A pogo (spring) portion (not shown) inside the body portion 150 exerts an elastic force onto the mating portion 1502. The tail portion 152 is soldered to the conductive pad 1102, thus the first contact 12 and the second contact 15 may achieve electrical connection. However, in alternative embodiment, the first contact 12 and the second contact 15 may be incorporated into an one-piece contact member.

The metallic shell 13 includes rectangular shaped body portion 130 and a U-shaped engagement portion 132 extending rearward from bottom side and lower sections of lateral sides of the body portion 130. The body portion 130 is adapted for accommodating the first insulated housing 11, while the engagement portion 132 is adapted for accommodating the second insulated housing 14. The engagement portion 132 has a bottom side 1320 and a pair of lateral sides 1321 extending upward from side edges of the bottom side 1320. A pair of circular-shaped holes 1322 are defined in a front section of a bottom side 1320. Two rectangular-shaped first retaining holes 1323 are defined in the front section of the bottom side 1320 and arranged outside of the holes 1322. Each of the lateral sides 1321 further defines two rectangular-shaped second retaining holes 1324 along a front-to-rear direction, disposed adjacent to the first retaining holes 1323.

The second connector 2 is an Audio Plug connector, however, it can be other types connector. The second connector 2 includes a cylindrical-shaped base portion 20 and a rod-shaped mating portion 22 extending forwardly from the base portion 20. The mating portion 22 includes a number of first terminals 220 insert-molded with an insulator 222 and isolated from each other. A panel member 23 is attached to a rear portion of the mating portion 22.

A number of second terminals 25 are insert-molded with the base portion 20 and separated from each other along a transversal direction. Each of the second terminals 25 has a semi-circular shaped mating segment 251 located in a peripheral portion of the base portion 20 and two L-shaped tail portions 253 extending inwardly from ends of the mating segment 251 and disposed adjacent to one another. The tail portions 253 hold the panel member 23 and are soldered to distal ends (not numbered) of the first terminals 220. The base portion 20 is made of insulative material and molded over the tail portions 253 of the second terminals 25, the panel member 23 and a rear segment of the mating portion 22. However, it is noted that the mating segment 251 may be configured to be arc or curved shapes.

Two cam portions 24 are arranged at lateral sides of the base portion 20, with a number of positioning grooves 242 are defined in a peripheral portion thereof. The positioning grooves 242 are separated from one another around the cam portions 24.

The hinge member 3 is made of sheet metal and includes a first engaging portion 30 and a second engaging portion 32 connected to the first engaging portion 30. The first engaging portion 30 includes a top side 301, two lateral sides 302 extending downward from lateral edges of the top side 301. Two L-shaped arm portion 303 extend downwardly from the lateral edges of the top side 301 and are disposed at backward of the lateral sides 302. A pair of stump portions 304 extend rearward from lateral sides of the top side 301, being connected to the arm portion 303. A positioning member 305 is unitarily formed at a free end of the arm portion 303 and arranged below the stump portion 304. Three circular holes 3011 are arranged to triangular shape and located in a middle section of the top side 301. A pair of first tabs 3021 are formed on an each lateral side 302. The second engaging portion 32 includes two ring-shaped coupling portions 321 connected to ends of the stump portions 304 and a substantially I-shaped (or H-shaped) bridging portion 322 connected to ends of the coupling portion 321. The bridging portion 322 is under the arm portion 303. A pair of second tabs 323 are located at rear ends of the bridging portion 322. The positioning members 305 further respectively extend into the two coupling portions 321.

The cover 4 includes a first shield part 41 and a second shield part 42 holding the first and second connectors 1, 2.

The first shield part 41 includes a top wall 411, a pair of transversal walls 412, 413, and a rear wall 414 joined together to form a first receiving space 410. The first shield part 41 further has a front outlet 415 and a back outlet 416 respectively communicating with the first receiving space 410. Two first concave portions 4141 are respectively defined in an inner side of the rear wall 414 and located at lateral sides of the back outlet 416, while two second concave portions 4142 are also defined in the inner side of the rear wall 414 and respectively disposed outside of the first concave portions 4141. The first concave portions 4141 are deeper than the second concave portions 4142. Both the first and second concave portions 4141, 4142 have curved interior surface. A first support member 4111 is located in the first receiving space 410 and extends downwardly from an inner side of a rear portion of the top wall 411. The first support member 4111 has a curved back surface and a number of cavities 4113 located in a top portion thereof. Three first posts 4112 are located in the first receiving space 410 and formed on the inner side of the top wall 411. The first posts 4112 are aligned in triangular-shape and disposed in front of the first support member 4111.

The second shield part 42 is similar to the first shield part 42, and detailed description is omitted hereby.

When assemble, the hinge member 3 is mounted to the first receiving space 410 of the first shield part 41, with the top side 301 laid on the inner side of the top wall 411, the first posts 4112 inserted through the holes 3011 in the top side 301, upper sections of the coupling portions 321 located in the second concave portions 4142, thus the first engaging portion 30 of the hinge member 3 is securely engaged with the first shield part 41. Secondly, the second connector 2 is assembled to the hinge member 3, with the cam portions 24 held by the coupling portions 321, an upper portion of the base portion 20 located in the first concave portions 4141, a back portion of the base portion 20 riding/relying against the back surface of the first support member 4111, the mating portion 22 extending out of the first shield part 41 via the back outlet 416. Thirdly, the first connector 1 is fastened to the hinge member 3, with the second tabs 323 locked into the first retaining holes 1323, the first tabs 3021 locked into the second retaining holes 1324, the posts 4112 inserted into the apertures 1404 of the second insulated housing 14. Thus, the first connector 1 is combined together with the hinge member 3. The body portions 150 of the second contacts 15 are partially located in cavities 4113 of the first support member 4111, with the mating portions 1502 resiliently pressing onto the mating segments 251 of the second terminals 25. Fourthly, the second shield part 42 is assembled to the first shield part 41, with second posts 4212 thereof passing through the holes 1322 in the bottom side 1320 and inserted into the apertures 1405 of the second insulated housing 14, a second support member 4211 standing on the first support member 4111 to retain the body portions 150 of the second contacts 15 therebetween, lower sections of the coupling portions 321 located in second concave portions 4242, a lower section of the base portion 20 is located in first concave portions 4241, the front portion of the base portion 20 riding/relying against the rear surface of support member 4211. Retaining means, such as glue or rivets is utilized to combine the first and second shield part 41, 42 together.

The cam portions 24 are pivotally engaged with the coupling portions 321 of the hinge member 3, thus the second connector 2 and the first connector 1 are capable of swiveling with respect to one another, with the mating portions 1502 of the second contacts 15 sliding along and resiliently contacting the mating segments of the second terminals 25 to have the first connector 1 and the second connector always main good electrical interconnection therebetween. Furthermore, the positioning member 305 joggles or engages with the positioning grooves 242, which have the second connector 2 angled stopping. By such arrangement, an orientation or position of the second contactor 2 may be selected, which is convenient for users.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection device, comprising:

a first connector having an insulated housing and at least a pogo type contact mounted to the insulated housing;

a second connector having a base portion and a terminal assembled to the base portion, said terminal having an arc-shaped mating segment; and said first connector pivotally linked to the second connector by a hinge member, with the insulated housing disposed adjacent to the base portion, the contact pressing onto and sliding along the mating segment of the terminal while the first connector and the second connector are swiveled with respect to one another;

said hinge member made of sheet metal and including a first engaging portion connected with a second engaging portion, said first engaging portion fixed to the first connector and the second engaging portion pivoted with the second connector;

wherein the first connector includes a first insulated housing assembled to a second insulated housing;

wherein two arm portions are formed on the second insulated housing, and each of the arm portions has a groove defined in an inner side thereof to receiving a corresponding side edge of a board member which is integrated with the first insulated housing.

2. The electrical interconnection device as claimed in claim 1, wherein two cam portions are arranged at lateral sides of the base portion and pivotally engaged with coupling portions of the second engaging portion.

3. The electrical interconnection device as claimed in claim 2, wherein at least a positioning member is unitarily formed with the hinge member and extends into one of the coupling portions, said positioning member is selectively engaged with corresponding positioning grooves of the cam portion while the first connector and the second connector are rotated with respect to one another.

4. The electrical interconnection device as claimed in claim 1, wherein the mating segment of the terminal is located in a peripheral side of the base portion.

5. The electrical interconnection device as claimed in claim 1, wherein the contact is assembled to the second insulated housing, with a tail portion thereof is disposed outside of the second insulated housing and soldered to a conductive pad on the board member.

6. The electrical interconnection device as claimed in claim 1, wherein a metallic shell encloses the insulated housing of the first connector and engages with the hinge member.

7. An electrical interconnection device, comprising:

a first connector having an insulated housing and a number of contacts mounted to the insulated housing;

a second connector having an insulative main portion and a number of terminals assembled to the main portion; and the first connector pivotally linked to the second connector, with mating portions of the contacts resiliently contacting and moveable along mating segments of the terminals such that the first connector and the second connector maintain electrical interconnection;

wherein a cover is utilized for holding the first connector and the second connector.

8. The electrical interconnection device as claimed in claim 7, wherein the cover is fixed with the first connector and pivotally linked with the second connector.

9. The electrical interconnection device as claimed in claim 7, wherein the cover includes a first shield part and a second shield part, wherein the first and second shield part both have a number of walls together enclosing a receiving space to partially accommodate the first connector and the second connector.

10. The electrical interconnection device as claimed in claim 9, wherein two support members are respectively formed on inner sides of the first and second shield part and arranged adjacent to rear walls of the cover.

11. The electrical interconnection device as claimed in claim 10, wherein each of the support members defines a number of cavities retaining the contacts of the first connector.

12. The electrical interconnection device as claimed in claim 7, wherein the contacts of the first connector are configured to be pogo-type contact members which have mating portions resiliently contacting curved mating segments of the terminals of the second connector.

13. The electrical interconnection device as claimed in claim 7, wherein each of the terminals of the second connector has two tail portions.

14. An electrical interconnection device comprising:

a main body defining two opposite first and second ends;

a first connector part having a first mating portion located adjacent and inside the first end, a plurality of first contact units disposed on the first mating portion; and a second connector part defining a columnar base portion pivotally mounted at the second end and a columnar second mating portion swiveling and directly extending from the base portion outside the second end in a direction perpendicular to an axis of said columnar base portion, a plurality of second contact units disposed on the second mating portion; wherein the first connector part further includes a plurality of first terminals each electrically connected to the corresponding first mating portion, the second connector further includes a plurality of second terminals each electrically connected to the corresponding second mating portion under condition that one of said first terminal and said corresponding second terminal extends along a circumferential manner to have thereon different positions constantly mechanically and electrically engaged with a constant position of the other of the first terminal and the corresponding second terminal;

wherein the first terminal is discrete from the corresponding first contact unit via an internal circuit board for electrical connection therebetween.

15. The electrical connection device as claimed in claim 14, wherein at least one of the first terminal and the corresponding engaged second terminal provides an elastic force in a radial direction of said base portion for assuring mechanical and electrical engagement therebetween.

16. The electrical connection device as claimed in claim 14, wherein said one of the first terminal and the corresponding second terminal is the second terminal, and the other of the first terminal and the corresponding second terminal is the first terminal.

17. The electrical connection device as claimed in claim 14, wherein the second terminal defines a semi-circular mating segment to contact the corresponding first terminal, and two tail sections extending from two opposite ends of the mating segment to sandwich therebetween a panel member which is connected to the columnar second mating portion.

* * * * *